United States Patent [19]

Spitz

[11] Patent Number: 4,901,382

[45] Date of Patent: Feb. 20, 1990

[54] MOUNTING APPARATUS FOR WALL BEDS

[76] Inventor: Melvin P. Spitz, 619 N. Elm Dr., Beverly Hills, Calif. 90210

[21] Appl. No.: 221,756

[22] Filed: Jul. 20, 1988

Related U.S. Application Data

[63] Continuation-in-part of Ser. No. 143,374, Jan. 12, 1988.

[51] Int. Cl.[4] ..... A47C 17/40

[52] U.S. Cl. ..... 5/136; 5/53 B; 5/164 R

[58] Field of Search ..... 5/164 R, 164 B, 164 C, 5/136, 53 R

[56] References Cited

U.S. PATENT DOCUMENTS

| | | | |
|---|---|---|---|
| 1,624,222 | 4/1927 | Duvall | 5/164 R |
| 1,820,672 | 8/1931 | Muchlinski | 5/164 R |
| 1,837,211 | 12/1931 | Duvall | 5/164 R |
| 1,898,578 | 2/1933 | Fox | 5/164 R |
| 3,179,956 | 4/1965 | Bennett | 5/164 R |
| 3,464,070 | 9/1969 | Driver | 5/164 R |
| 3,550,167 | 12/1970 | Bennett | 5/164 R |
| 4,466,147 | 8/1984 | Yokol et al. | 5/164 R |

*Primary Examiner*—Alexander Grosz

*Attorney, Agent, or Firm*—Plante, Strauss, Vanderburgh and Connors

[57] ABSTRACT

A wall bed is disclosed employing a linkage assembly which moves the wall bed outwardly from a wall or cabinet in a fashion so that the head end of the bed will not be in the cavity and the level of the mattress will be at a height which approximately corresponds to the height of conventional beds. Three counter-balancing spring assemblies are disclosed. One employs an angle member which connects extension springs to the bed base so that they are contained within a compact structure which is received within the cavity. The second employs a linkage assembly having short and long links pivotably connected to each other by their ends, with an extension spring connected to the short link and a mounting frame. The third employs a linkage assembly with extension springs that neutralize the counter-balancing force when the wall bed is open to eliminate floating. A headboard is also provided which may be tilted rearwardly or positioned at a right angle to the sleeping surface.

7 Claims, 18 Drawing Sheets

10
12
14
16
18
20
21
22
24
24a
24b
25
26
28
30
32
34a
34b
35
36
38
4
52
54
60
62
65
67
68
70
76
78
80
82
84
86
90
92
94
96
98
100
102
104
2

200
202
202a
204
206
208
210
212
214
216
218
220
222
224
226
228
230
232
234
236
18
20
21
30
40
70
1
2
4
-3-

15
14
20
18
70
200
204
30
40
202
202a
206
208
210
212
214
216
218
220
222
224
226
228
230
232
234
236
-4-
-2-
-21-

MOUNTING APPARATUS FOR WALL BEDS

RELATED APPLICATION

This application is a continuation-in-part application of U.S. Ser. No. 143,374, filed Jan. 12, 1988, entitled "MOUNTING APPARATUS FOR WALL BEDS," and which is incorporated herein and made part of this application.

BACKGROUND OF THE INVENTION

1. Field of the Invention

This invention relates to wall beds, and in particular a mounting apparatus for wall beds which moves the bed completely out of the wall and elevates it to the correct position above the floor. It includes a unique counter-balancing spring assembly to facilitate easy opening and closing of the wall bed.

2. Background Discussion

Wall beds are conventional articles of manufacture which call for a rigid, non-folding bed to be mounted in a generally vertical position within a cavity in a wall and hinged at the lower end so that the bed can be moved from the vertical to the horizontal position. In some instances a cabinet-like structure is provided to house the bed with the underside of the bed base providing a cabinet front face when the bed is in the closed, vertical position.

It is highly desirable that the entire bed surface be moved outside of the cavity upon opening. In other words, that portion of the bed surface adjacent the pivotably mounted end of the wall bed desirably is moved outwardly from the cavity. When this is done, no portion of the sleeping surface of the bed is located in the cavity. This overcomes an objection of some users of wall beds who experience claustrophobia if they are required to sleep with their head, or another portion of their body, within the cavity. Also, it is desirable for the bed upon opening to be raised to an appropriate level where the top surface of the mattress will be at approximately the same distance from the floor as a conventional bed. Moreover, it is highly desirable for the wall bed to be easily opened and closed, and when in the open position resting firmly on the floor and not tending to "float." A "floating" condition can be experienced due to the counter-balancing spring assembly acting on the open bed and tending to lift up the bed.

SUMMARY OF THE INVENTION

The present invention provides a way for wall beds to be mounted so that, upon opening, the the entire sleeping surface of the wall bed is moved outwardly from the wall cavity containing it and raised to a sufficient height where the top surface of the mattress will be at approximately the same distance from the floor as a conventional bed, typically about 19 to about 21 inches. The present invention includes linkage means which achieves this movement of the bed, and a unique counter balancing spring assembly for facilitating opening and closing of the wall bed. This invention also includes an adjustable headboard.

There are several features of this invention which contribute to the desired attributes discussed above, no single one of which is solely reSponsible for these attributes. Without limiting the scope of this invention as expressed by the claims, its more prominent features will now be discussed briefly. After considering this discussion, and particularly after reading the section of this application entitled DETAILED DESCRIPTION OF THE PREFERRED EMBODIMENT, one will understand how the features of this invention provide its desirable attributes.

One feature of this invention is the use of a linkage assembly which connects the bed base to a mounting element within the wall cavity. The linkage assembly includes a plurality of lever arms which coact to pivot and move the bed base outwardly from the wall cavity to place the sleeping surface beyond the cavity and elevate the sleeping surface to the desired height above the floor when horizontal.

The second feature of this invention is a counter balancing spring assembly which acts to prevent the wall bed from falling heavily upon being opened and assists in closing the bed when it is desired to return the bed to the wall cavity. This counter-balancing spring assembly is compact in depth and height so that it fits within the confined space in the wall cavity, and takes up minimal space from the floor (less than four inches) when the bed is closed and positioned above the spring assembly.

Three different types of counter-balancing spring assemblies are disclosed. One uses a pivotably mounted angle arm with spring connected to it in a fashion that provides the counter-balancing action. The second uses a pair of pivotably connected link members that eliminate the angle arm and, within the confined space available, enable the extension spring to stretch near its maximum, but not exceed the maximum. The third uses four link members and an extension spring connected together in a way that enables the spring to act on the bed base to provide a counter-balancing force as the bed is opened and closed, but effectively neutralizes the counter-balancing force when the bed is open. Thus, "floating" is eliminated.

The third feature of this invention is a headboard which may be at a right angle with respect to the open bed's surface or tilted rearwardly, sloping backwards. This headboard is in two sections and folds and unfolds as the bed is closed and opened.

BRIEF DESCRIPTION OF THE DRAWING

The preferred embodiment of this invention are illustrated in the drawing, wherein like numerals indicate like parts and in which.

DETAILED DESCRIPTION OF THE PREFERRED EMBODIMENT

Figure 1:
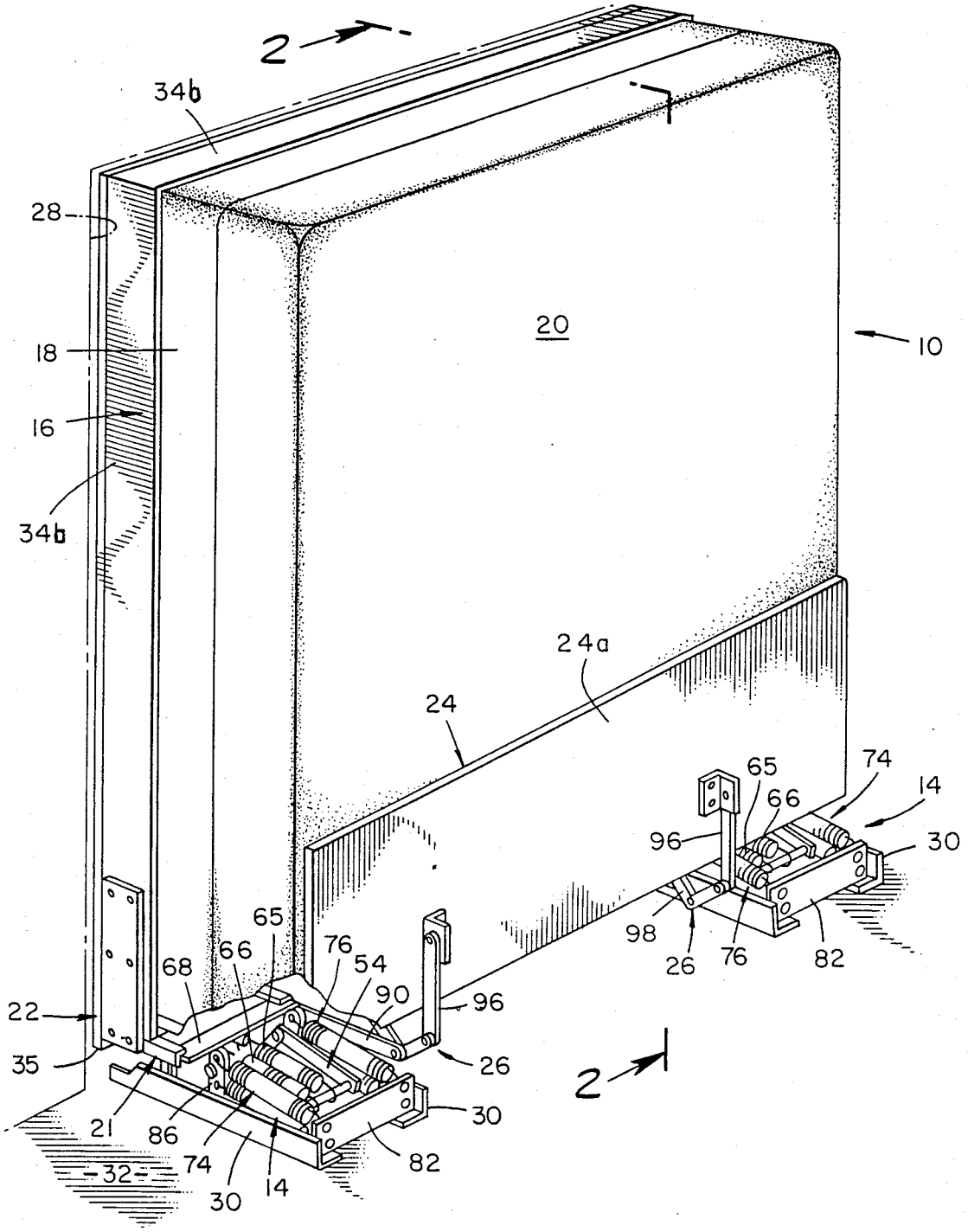
FIG. 1 is a perspective view of a closed wall bed employing the linkage and counter-balancing spring assemblies of this invention.

As shown in FIG. 1, a typical wall bed 10 is equipped with the linkage assembly 12 and counter balancing spring assembly 14 of this invention. There are two linkage assemblies and two counter balancing spring assemblies mounted to the left and right hand lower sides of the wall bed 10.

Figures 8, 9:
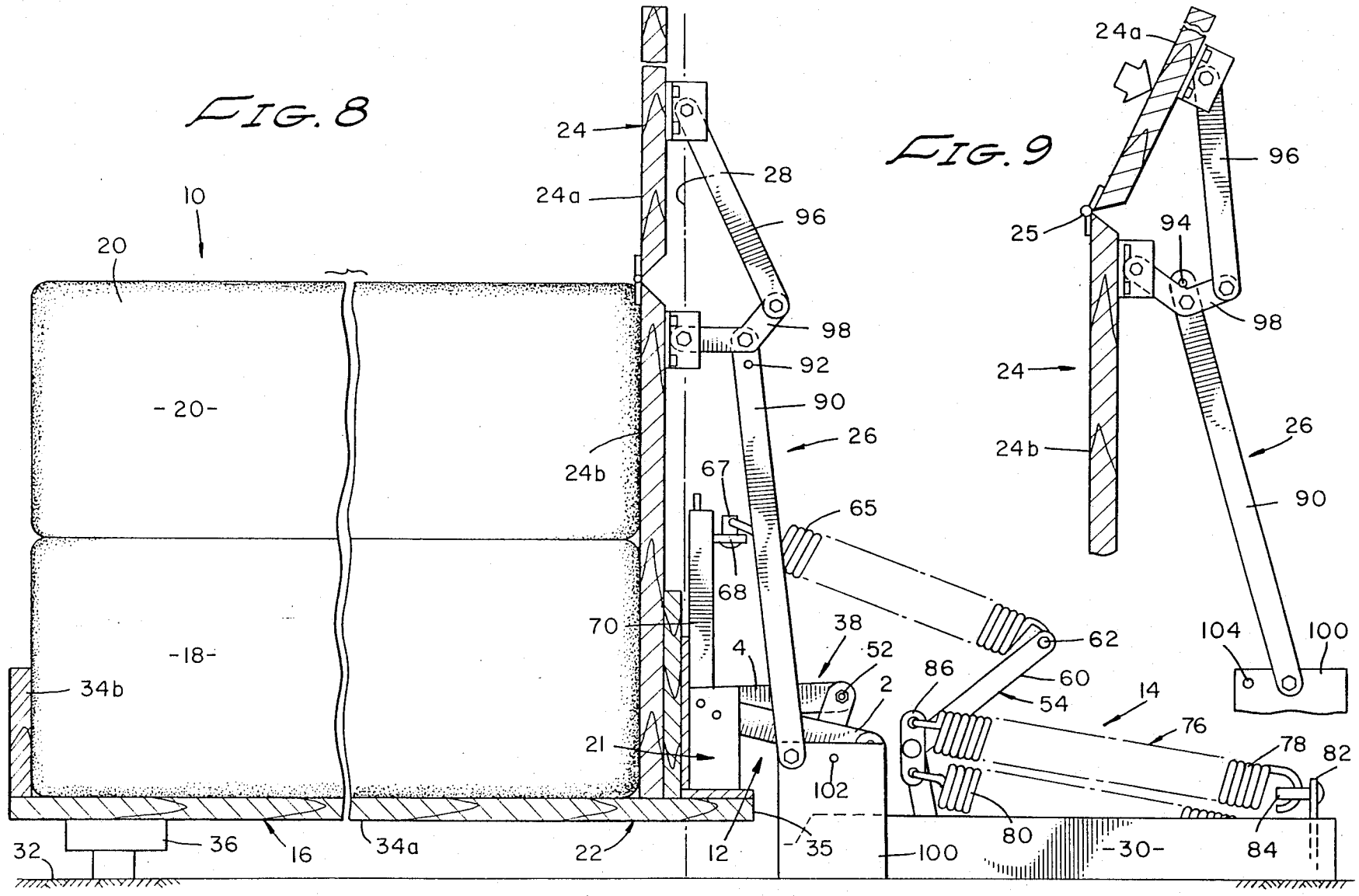
FIG. 8 is a fragmentary cross-sectional view showing the linkage and counter-balancing assemblies with the bed in the fully opened position.
FIG. 9 is a fragmentary view showing the headboard actuator adjusted to tilt the headboard of the wall bed.

The wall bed 10 includes a bed base 16, a box spring 18, and mattress 20. The lower end section 22 of the bed base 16 is equipped with reinforcing plates 21 (only one shown), which are connected to the linkage assembly 12 and counter balancing spring assembly 14. The end section 22 has secured to it a headboard 24 having two sections 24*a* and 24*b* hingedly connected together by hinge 25 and equipped with a headboard actuator 26 that unfolds the two sections as the wall bed 10 is moved from the vertical position within the wall cavity, 28 (shown in dotted lines in FIG. 1) and an open, horizontal position (FIG. 8). The linkage assembly 12 a d counter balancing spring assembly 14 are mounted within the wall cavity 28 and each is secured to a mounting frame 30 attached to the floor 32.

Figure 2:
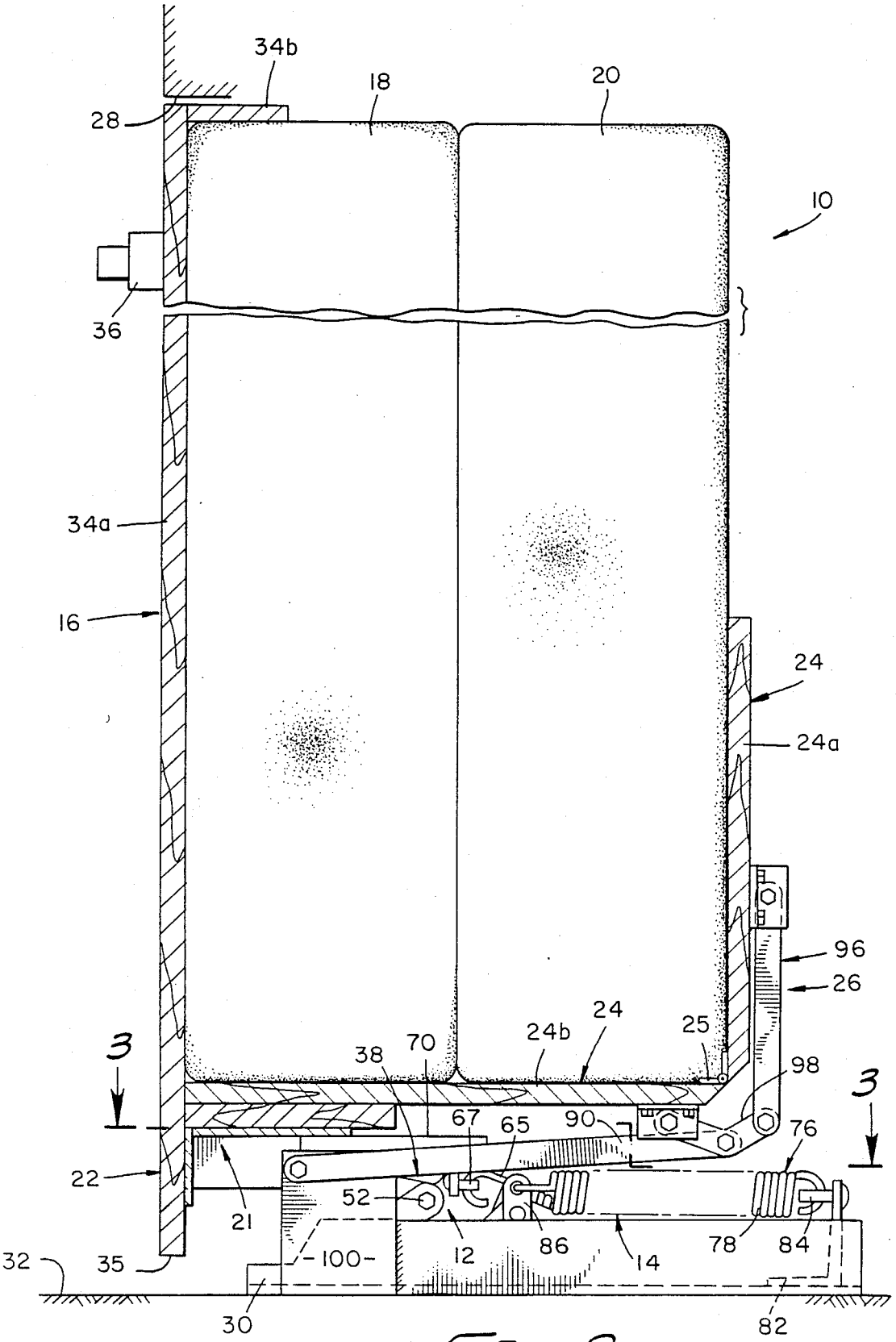
FIG. 2 is a cross-sectional view taken along line 2—2 of FIG. 1.

As best illustrated in FIG. 2, the bed base 16 comprises a flat wooden supporting member 34*a* having a framework 34*b* around its perimeter to contain the box spring 18. An end portion 35 of the supporting member 34*a* which is adjacent the floor 32 when the wall bed 10 is closed extends beyond the framework 34*b* to provide a site to attach a bracket assembly 21to the bed base near the hinge zone. It is important that the end portion 35 extend to a point near the floor 32 to minimize the "gap" between this portion 35 and the floor.

The linkage assembly 12 and counter balancing assembly 14 are secured to the bracket assembly 21, which in turn is fixedly secured to the end portion 35 of supporting member 34*a* and to the reinforcing plate 24. A pair of projections 36 (only one shown) extend outwardly from the supporting member 34*a* to serve as handles for grasping the closed wall bed 10 and as legs which rest against the floor 32 when the bed is opened fully. The underside surface of supporting member 34*a* may be finished to provide a cabinet-matching or wall-matching exterior.

Figure 3:
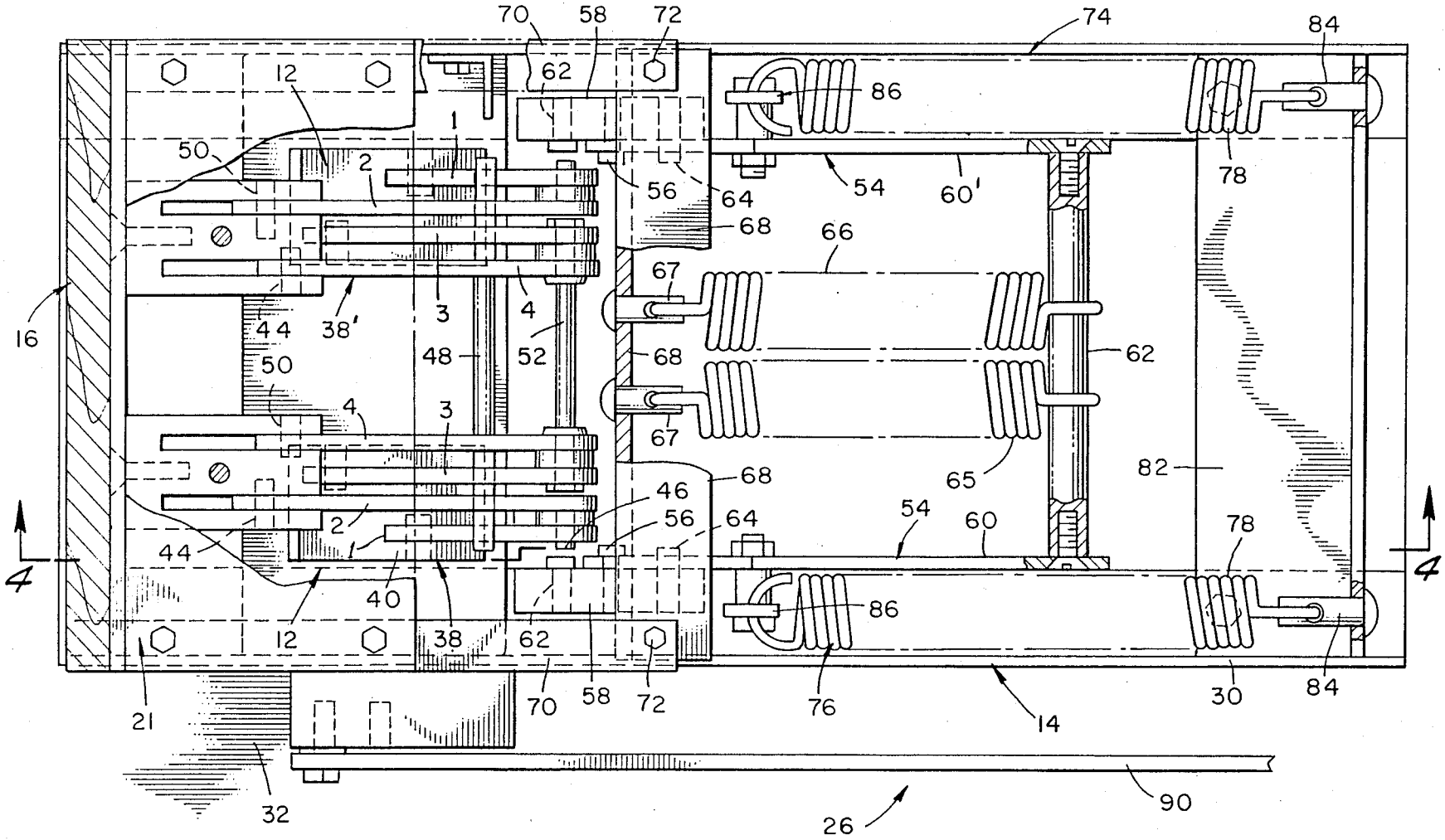
FIG. 3 is a cross-sectional view taken along line 3—3 of FIG. 2.
Figure 4:
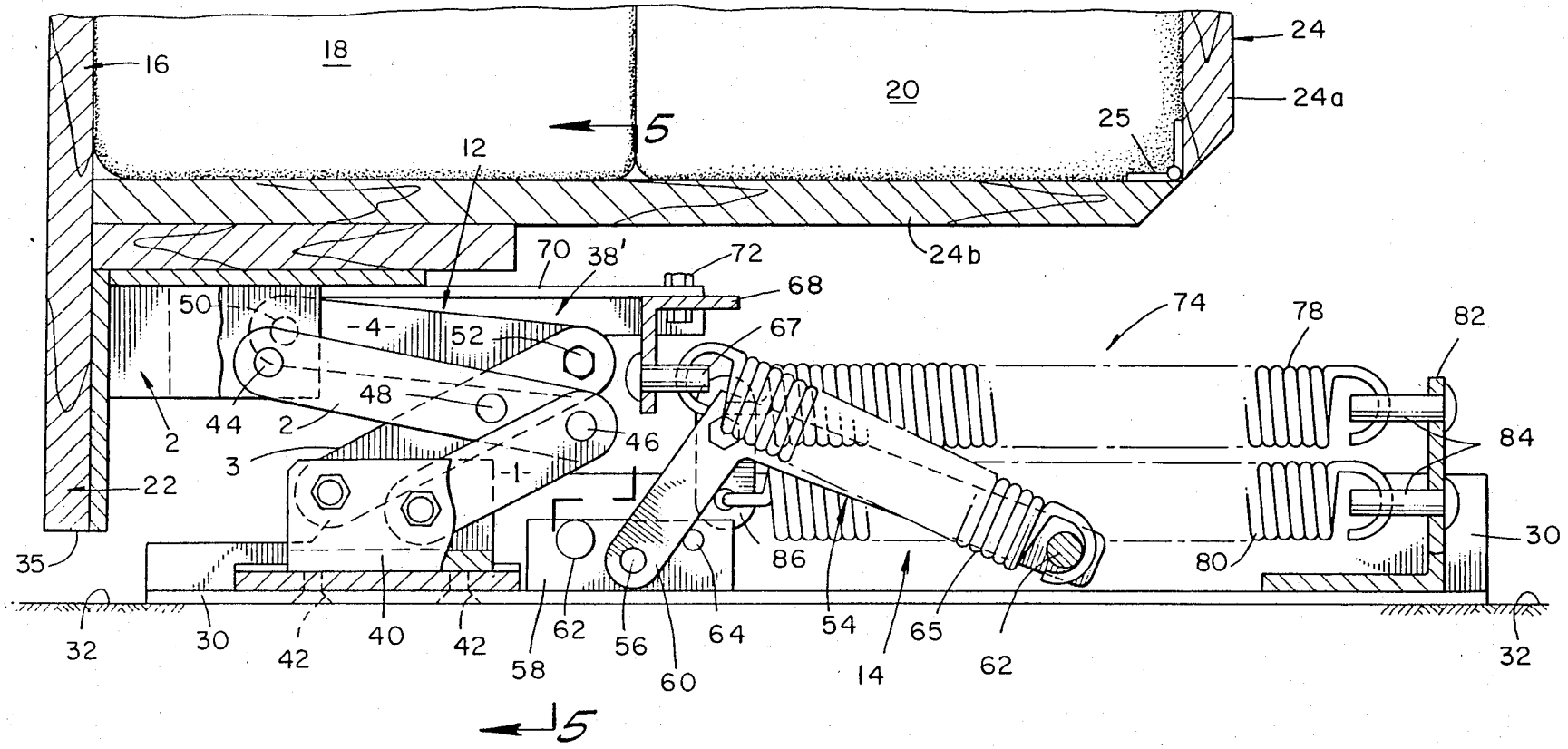
FIG. 4 is a cross-sectional view taken along line 4—4 of FIG. 3.
Figure 5:
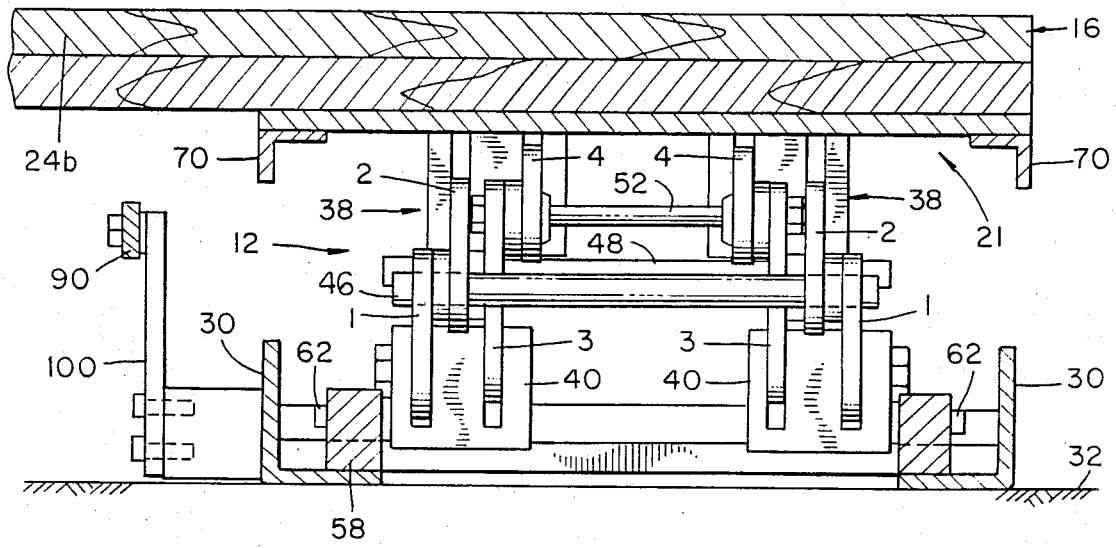
FIG. 5 is a cross-sectional view taken along line 5—5 of FIG. 4.
Figure 6:
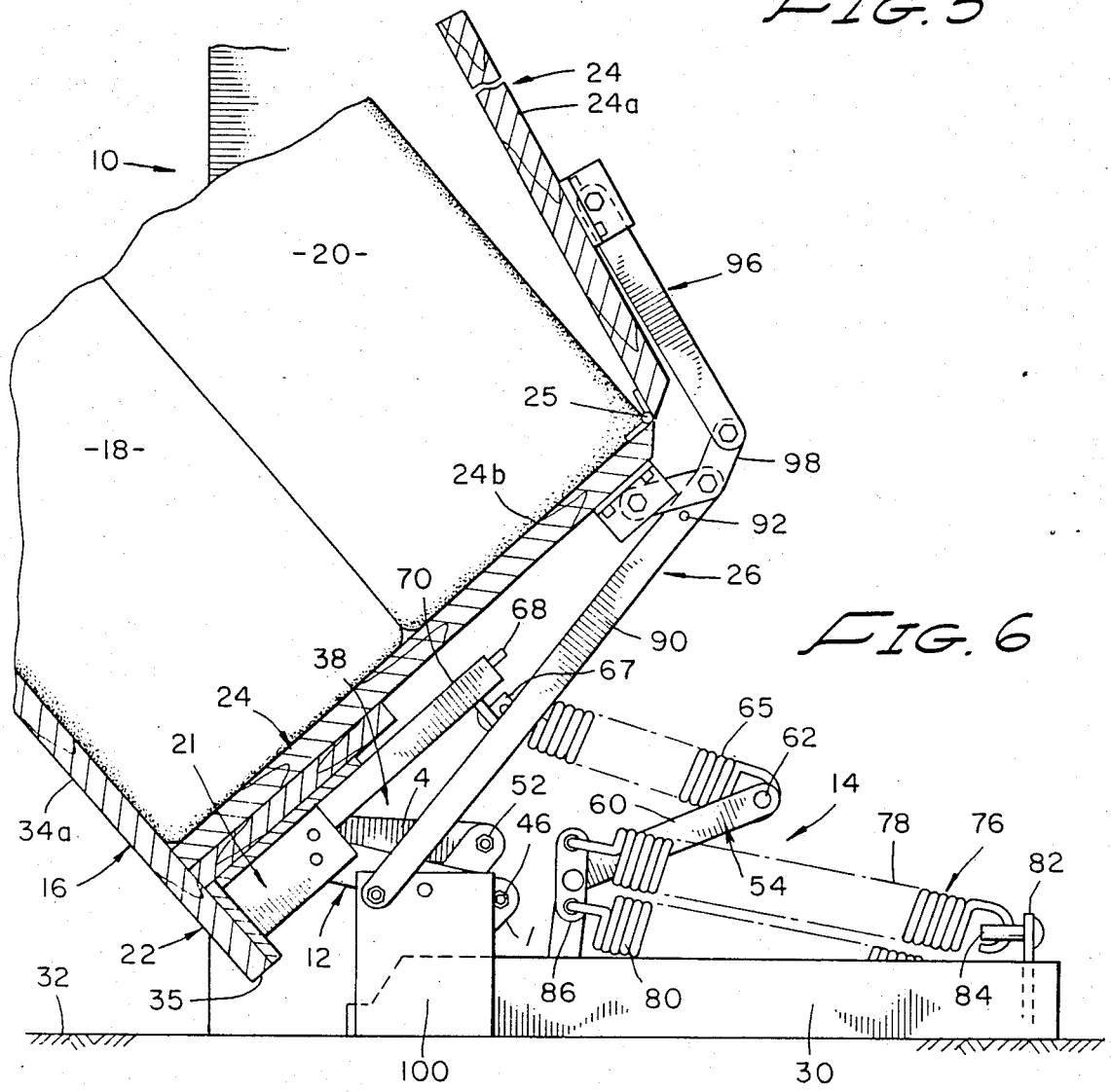
FIG. 6 is a fragmentary view in cross section showing the positions of the linkage and counter balancing spring assemblies as the wall bed is being opened or closed.
Figure 7:
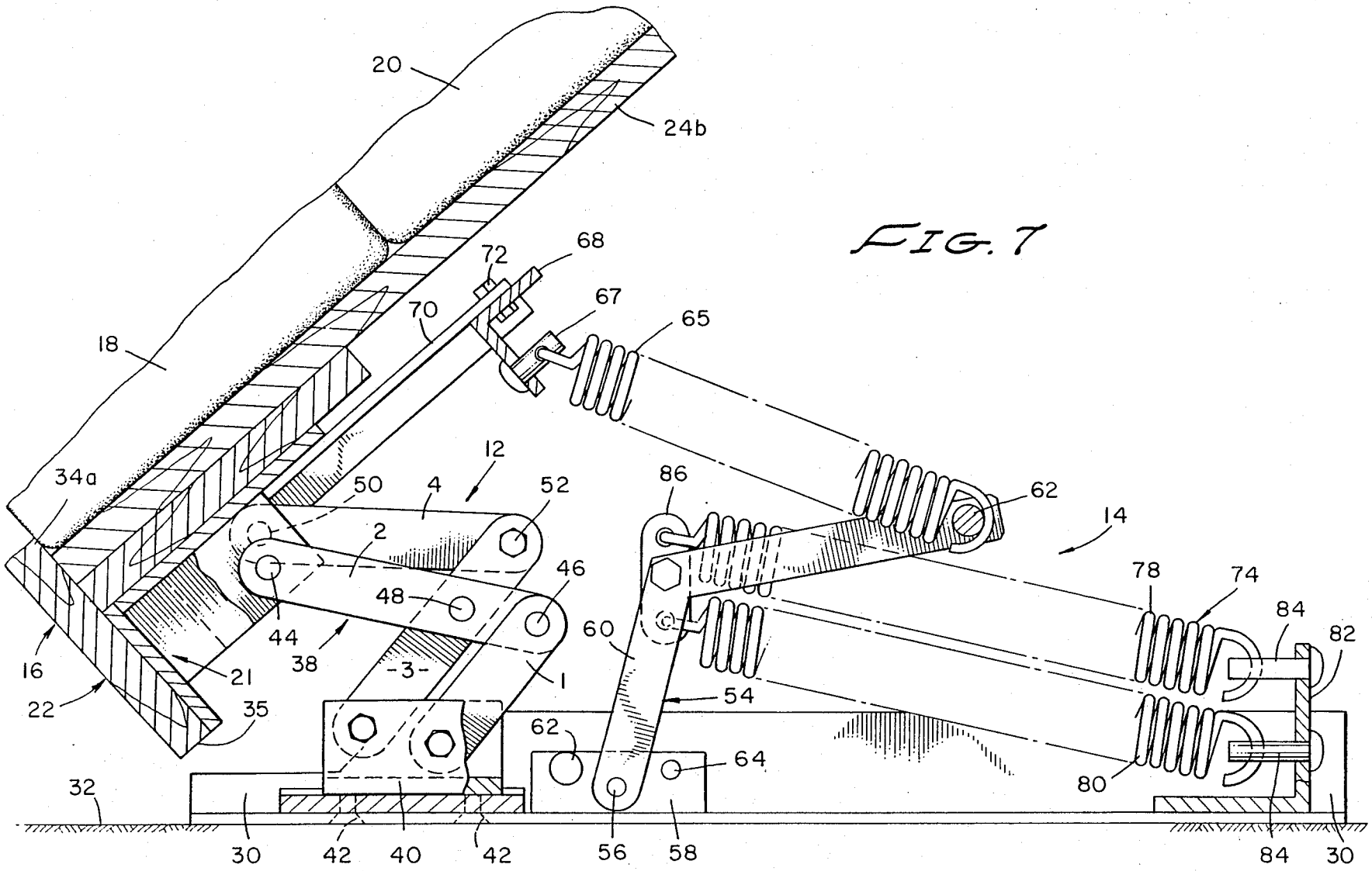
FIG. 7 is an enlarged, cross-sectional fragmentary view showing the linkage and counter-balancing spring assemblies as the wall bed is being fully opened or closed.
Figure 10:
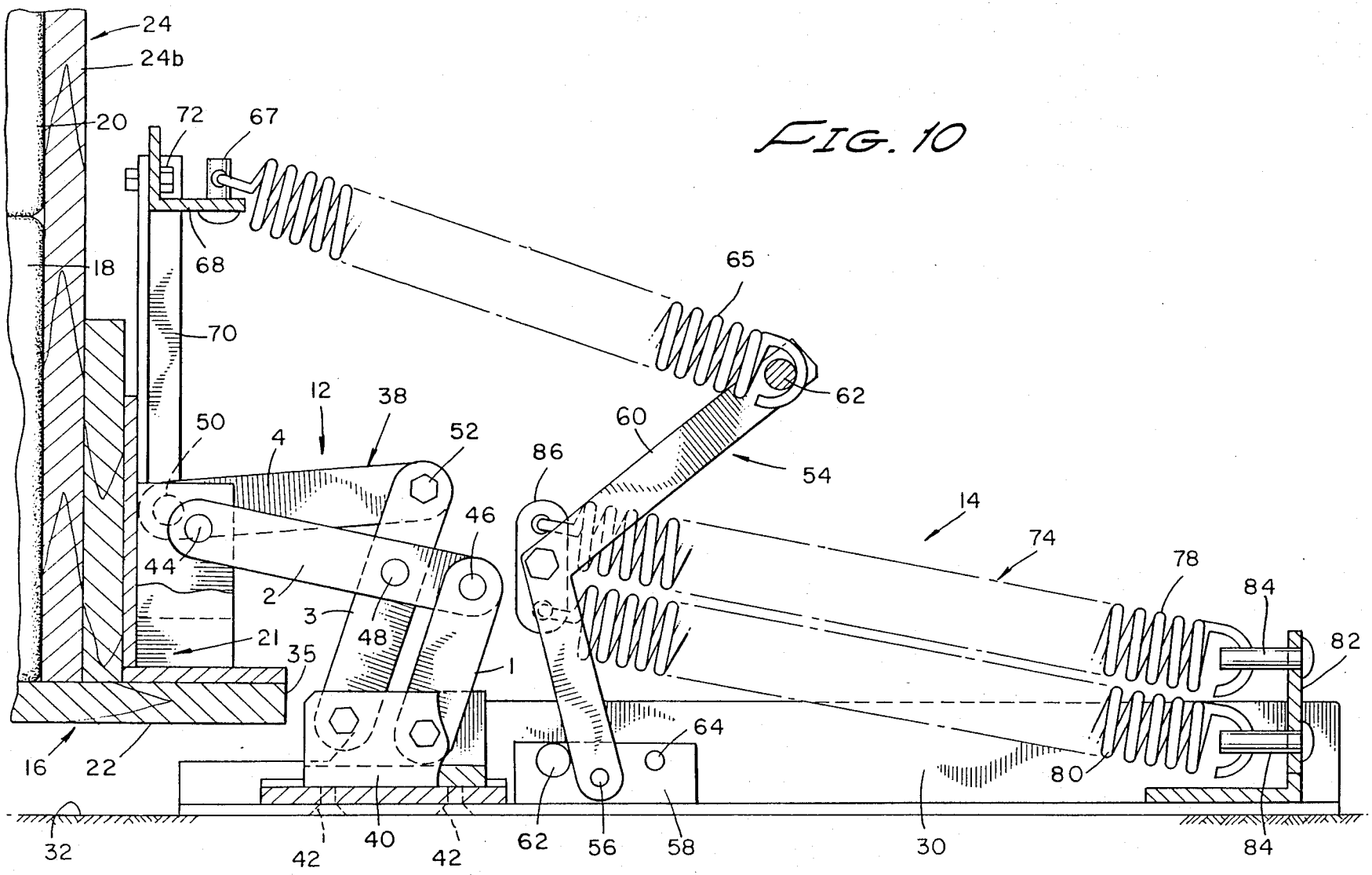
FIG. 10 is an enlarged, fragmentary view showing the linkage and counter balancing spring assemblies with the bed in the fully opened position.

For the purpose of providing a high degree of rigidity and lead carrying capacity the linkage assembly 12 includes two essentially identical sets of lever mechanisms 38 and 38′. As best shown in FIGS. 3, 4 and 5, each linkage mechanism 38 and 38′ includes four lever arms identified, respectively, as 1, 2, 3 and 4. Lever arms 1 and 3 are connected pivotably at one end to a pair of mounting blocks 40 secured by screws 42 to the mounting frame 30. The lever arms 1 and 3 are generally parallel to each other with lever arm 2 extending crosswise with respect to lever arms 1 and 3. The lever arm 2 has one end pivotably connected by a swivel pin 44 to the bracket assembly 21 and its opposed end connected by a swivel pin 46 to the free end of lever arm 1. A connecting rod 48 passes through the lever arms 2 and 3 of the one lever mechanism 38 and connects this mechanism to the complimentary lever mechanism 38′ as illustrated in FIGS. 3 and 5. The lever arm 4 has one end connected to the bracket assembly 21 positioned slightly above the lever arm 2 through a swivel pin 50 and has its other end connected by a connecting rod 52 to the free end of lever arm 3. Connecting rod 52 also couples the lever mechanism 38 to the lever mechanism 38′. Thus, when the wall bed 10 is opened and closed the four lever arms 1–4 move in unison as depicted in FIGS. 4, 7 and 10.

Figure 11:
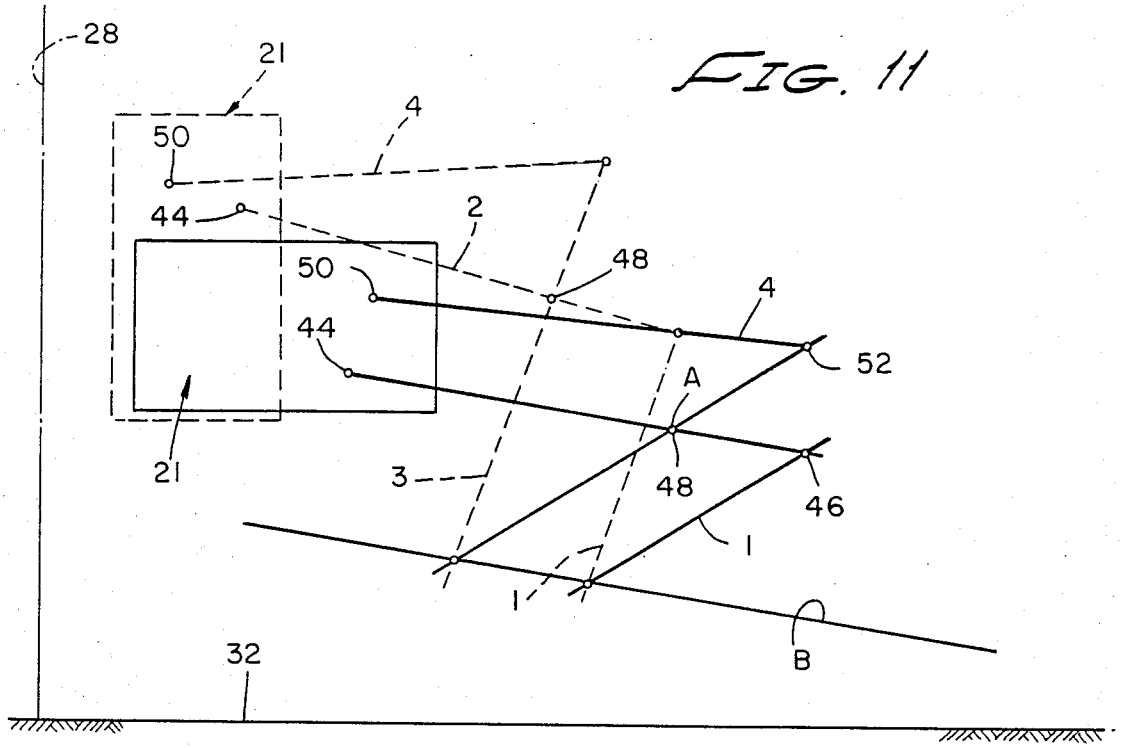
FIG. 11 is a a schematic diagram illustrating the movement of the lever arms of the linkage assembly.

In accordance with this invention, the linkage assembly 12 provides three functions. One, it lifts the bed base 16. Two, it rotates the bed base 16 through a 90 degree turn. Three, it moves the bed base 16 forward. If a conventional hinge were employed, these three functions would not occur and the sleeping surface of the mattress 20 would not be moved completely from the wall cavity nor be elevated to the desired height above the floor 32. These functions, as illustrated in FIG. 11, occur as the lever arms 1–4 move between a folded, closed position as shown in FIG. 4 to a completely open position in FIG. 10. Lever arm 1 is shorter than lever arm 3 and lever arm 2 is pivotably connected at point A and aligned with line B in parallel to define the sides of a parallelogram. As the linkage assembly 12 opens and closes, the angles of the parallelogram change, but the parallel relationship of the lever arms 1 and 3 remains. Lever arm 4 changes its angular relationship with lever arm 2 as the wall bed 10 opens. The length of the lever arms 1–4 are adjusted to move the wall bed 10 to the position desired. Specifically, the most desirable position in the open position is with the headboard 24 immediately adjacent but outside of the wall cavity 28, moving the sleeping surface of the mattress 20 entirely beyond the wall cavity, and with the sleeping surface between about 19 and about 21 inches above the floor 32. In the closed position, the underside of the supporting member 34*a* will be flush with the wall closing the open entry way of the wall cavity 28 and the end portion 35 just about touching the floo, typically about ¾ to about 1½ inches above the floor 32.

The counter balancing spring assembly 14 as illustrated in FIGS. 3 and 4 includes an angle arm 54 pivotably mounted at one end by pins 56 to mounting blocks 58 secured to the mounting frame 30. The mounting blocks 58 have on their exterior faces two stop members 62 and 64 which limit the pivotal movement of the angle arm 54. The angle arm 54 is a two piece structure with two identical L-shaped members 60 and 60′ (FIG. 3). The L-shaped members 60 and 60′ are spaced apart with a post 62 connecting them so that they move in unison. Disposed between the pair of L-shaped members 60 and 60′ are a pair of inner extension springs 64 and 66. The inner springs 64 and 66 each have one end hooked around the post 62 and the opposed end hooked into an eyelet bolt 67 connected to an angle iron fram 68 which is secured by a bolt 72 to a plate 70 that is part of the bracket assembly 21.

The counter balancing spring assembly 14 also includes two sets of outer springs 74 and 76. Each set 74 and 76 has two outer springs 78 and 80. Each spring 78 and 80 has one end connected to an L-shaped mounting plate 82 connected through eyelet bolts 84 with their opposed ends connected to a pivot plate 86 pivotably mounted at the bend of L-shaped members 60 and 60′. There are openings in plate 86 that permit the hooked ends of the coiled springs 78 and 80 to slip into the openings in the plate.

Figure 12A:
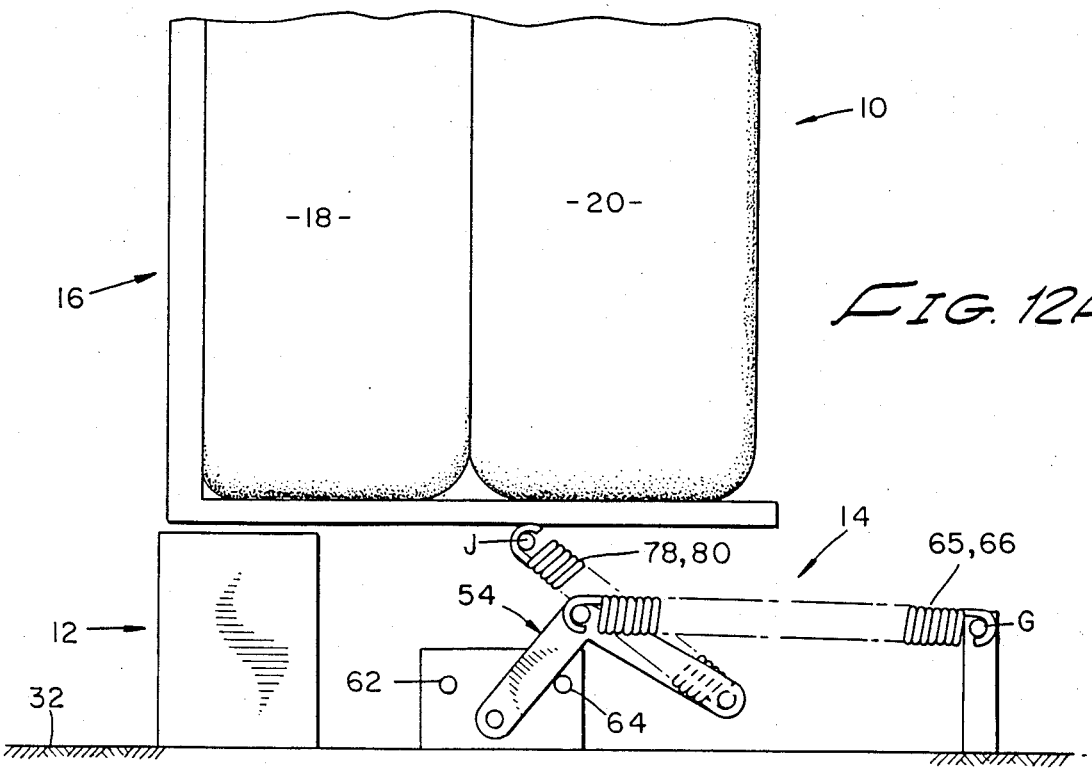
FIG. 12A is a simplified, diagramatic illustration of the counter balancing spring assembly in the closed position.
Figure 12B:
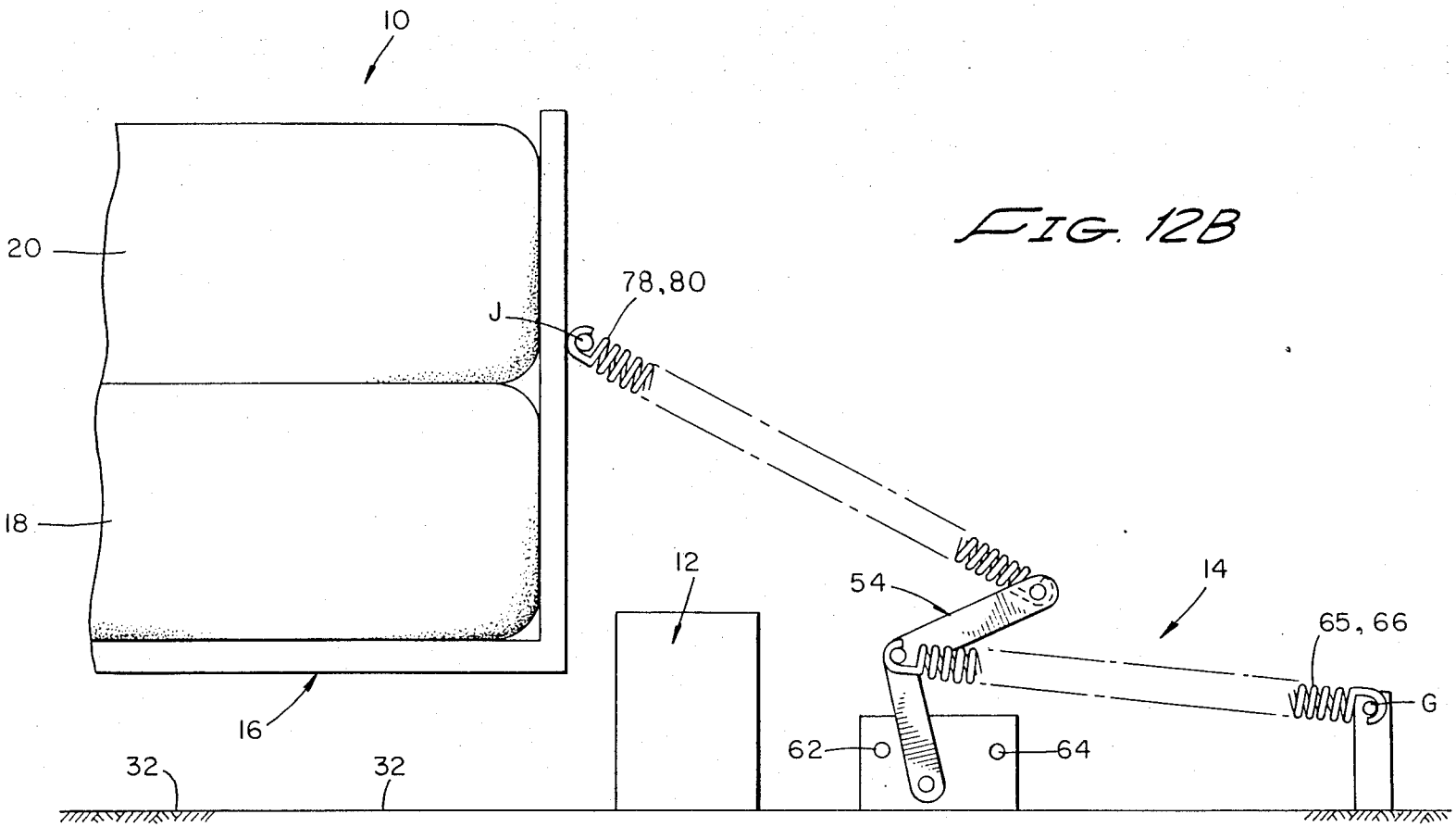
FIG. 12B is a simplified, diagramatic illustration of the counter balancing spring assembly similar to that shown in FIG. 12A showing the spring assembly in the open position.

The principal advantage of the counter balancing spring assemble 14 is that it fits into the confined space within the wall cavity. It deploys extension springs 64, 66, 78 and 80 so that they are in series rather than using one spring to extend between points J and G as illustrated schematically in FIGS. 12A and 12B. Ordinary extension springs would not be able to stretch between points J and G with the wall bed 10 in the open position as shown in FIG. 12B without exceeding their elastic limits. By using springs 64, 66, 78 and 80 in series and connected between points J and G through the angle arm 54, the elastic limits of those springs are not exceeded.

In accordance with another feature of this invention, the headboard 24 may be at a right angle with respect to the sleeping surface of the mattress 20 or tilted rearwardly as shown in FIG. 9. The headboard actuator includes an adjustable arm 90. This arm has two holes 92 and 94 at its top end, and is connected to a position linkage 96 which couples the two sections 24*a* and 24*b* of the headboard together so that the section 24*a* is folded over and rests on the sleeping surface of the mattress when the wall bed 10 is closed. The arm 90 is coupled either through hole 92 or 94 to the elbow of a link 98 and to a support plate 100. The plate 100 has two positioning holes 102 and 104. As illustrated in FIGS. 8 and 9, the effective length of the arm 90 is either lengthened or shortened to position the headboard 24 so that it is at a right angle or tilted rearwardly upon opening of the wall bed 10.

OPERATION

The wall bed 10 will typically be in the closed vertical position as illustrated in FIG. 1 with the balancing springs 64, 66, 78 and 80 of the counter balancing spring assembly 14 being undeflected and only at a slight initial tension. FIGS. 3 and 4 show the springs 64, 66, 78 and 80 in this position. The lever arms 1, 2, 3 and 4 of the linkage assembly 12 are in the collapsed position as shown in FIG. 4.

To open the wall bed 10 the user grasps the wall bed, for example, at the projections 36 and pulls outwardly, causing the head end of the bed base 16 to pivot. As the wall bed 10 moves from the closed to the open position, the extension springs 64, 66, 78 and 80 are placed in tension as illustrated in FIG. 7, and the linkage assembly 12 unfolds with the lever arms 1, 2, 3 and 4 opening up. Note that the lever arms 1 and 3 maintain a generally parallel position as they pivot about their respective ends. The connecting rod 48 connecting lever arm 2 to lever arm 3 causes all four lever arm 1, 2, 3 and 4 to move in unison. The lever arms 2 and 4 push the head end outwardly. As a consequence, when the wall bed 10 is in the horizontal position, the bed is moved outwardly from the wall cavity 28. As the bed moves to the horizontal position, the L-shaped members 60 and 60′ of the angle arm 54 engage the one stop 62 preventing further movement of this lever arm in a counterclockwise direction as viewed in FIG. 10.

To close the bed, the user simply grasps the foot end of the wall bed 10 and pushes it upwardly. Since wall beds 10 are typically very heavy structures, the springs 64, 66, 78 and 80 now assist the user in overcoming the weight of the bed as it is tilted inwardly toward the wall cavity 28. The stops 58 limit the movement of the angle arm 54 in the clockwise direction as viewed in FIG. 10.

ALTERNATE COUNTER-BALANCING SPRING ASSEMBLY

The first alternate counter-balancing spring assembly of this invention is shown in FIGS. 13 through 17. This counter-balancing spring assembly 200 employs two link members 202 and 204 and an extension spring 206. The first link member 202 has an offset portion 208 between the opposed ends of this link member to provide a relatively long section 202*a* which has extending outwardly from one side of a short stud 210 with a head 212 on it. This link member 202 has its one end 214 pivotably connected by a pivot pin 216 to a bracket 218 secured to the plate 70. The other end 220 of this link member 202 is pivotably connected by a pivot pin 222 to an end 224 of the link member 204. The other end 226 of the link member 204 is pivotably connected by a pivot pin 228 to a bracket assembly 230 secured to the mounting frame 30. The extension spring 206 has its one end 232 looped over the stud 210 and its other end 234 slipped through a bolt 236 having an eyelet opening in it. The bolt 236 is held in the bracket assembly 230 near the end 226 of the link member 204.

Figures 13, 16:
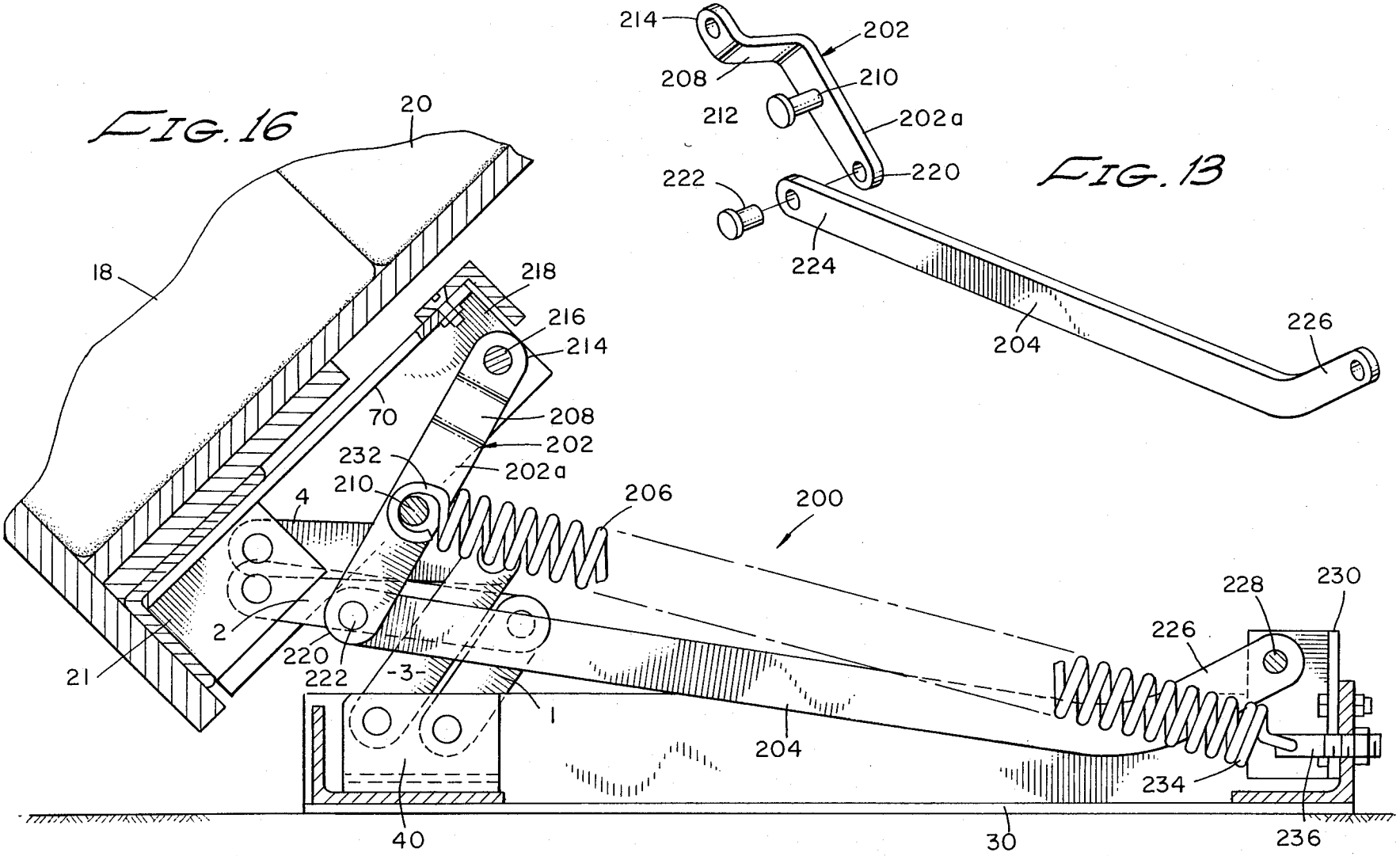
FIG. 13 is an exploded perspective view of the link assembly for the first alternate embodiment of the counter-balancing spring assembly of this invention.
FIG. 16 is a side elevational view, partly in cross-section, showing in a partially open condition the first alternate embodiment of the counter-balancing spring assembly of this invention.
Figures 14, 15:
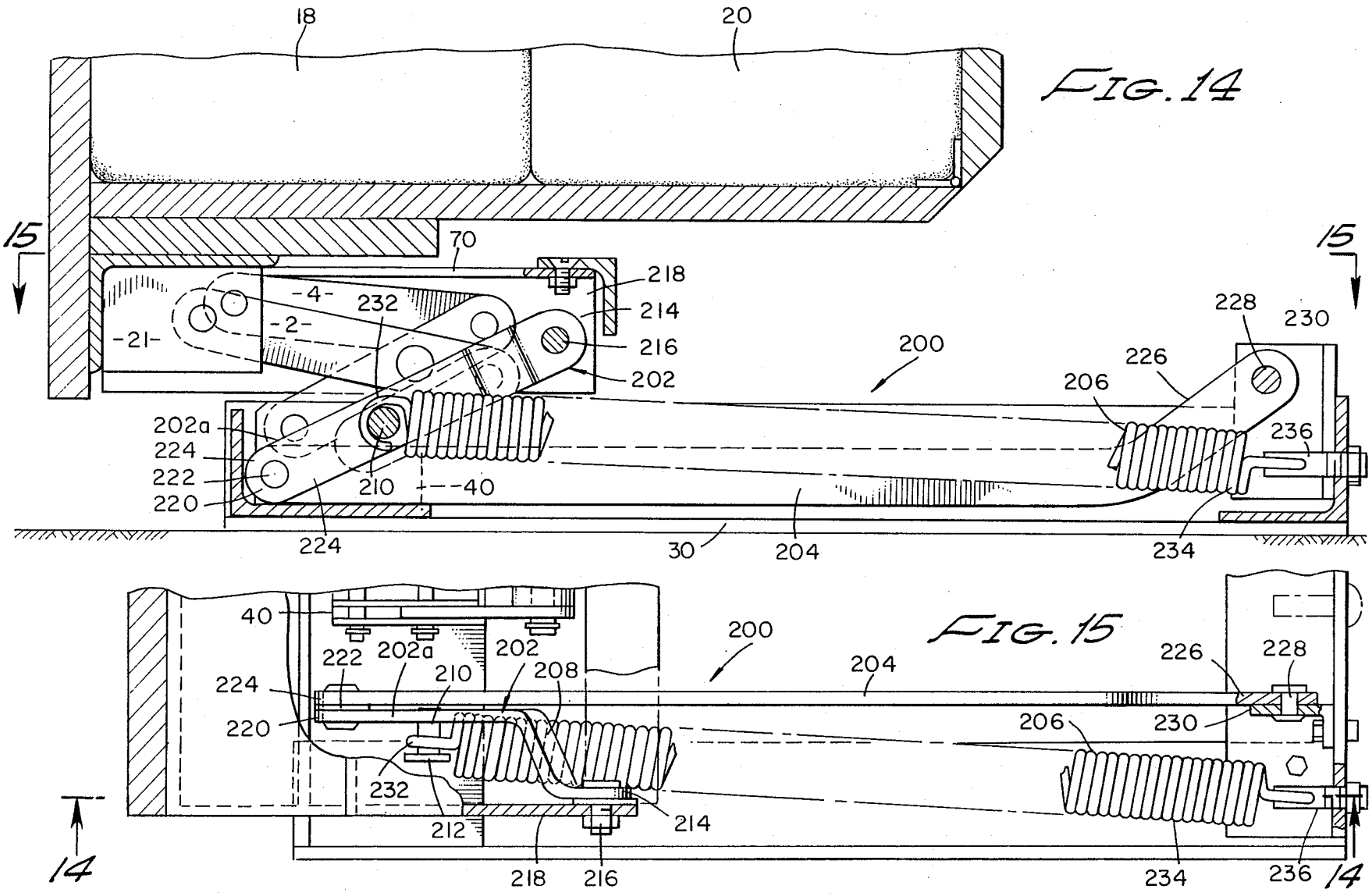
FIG. 14 is a cross-sectional view taken along line 14—14 of FIG. 15.
FIG. 15 is a cross-sectional view taken along line 15—15 of FIG. 14.
Figure 17:
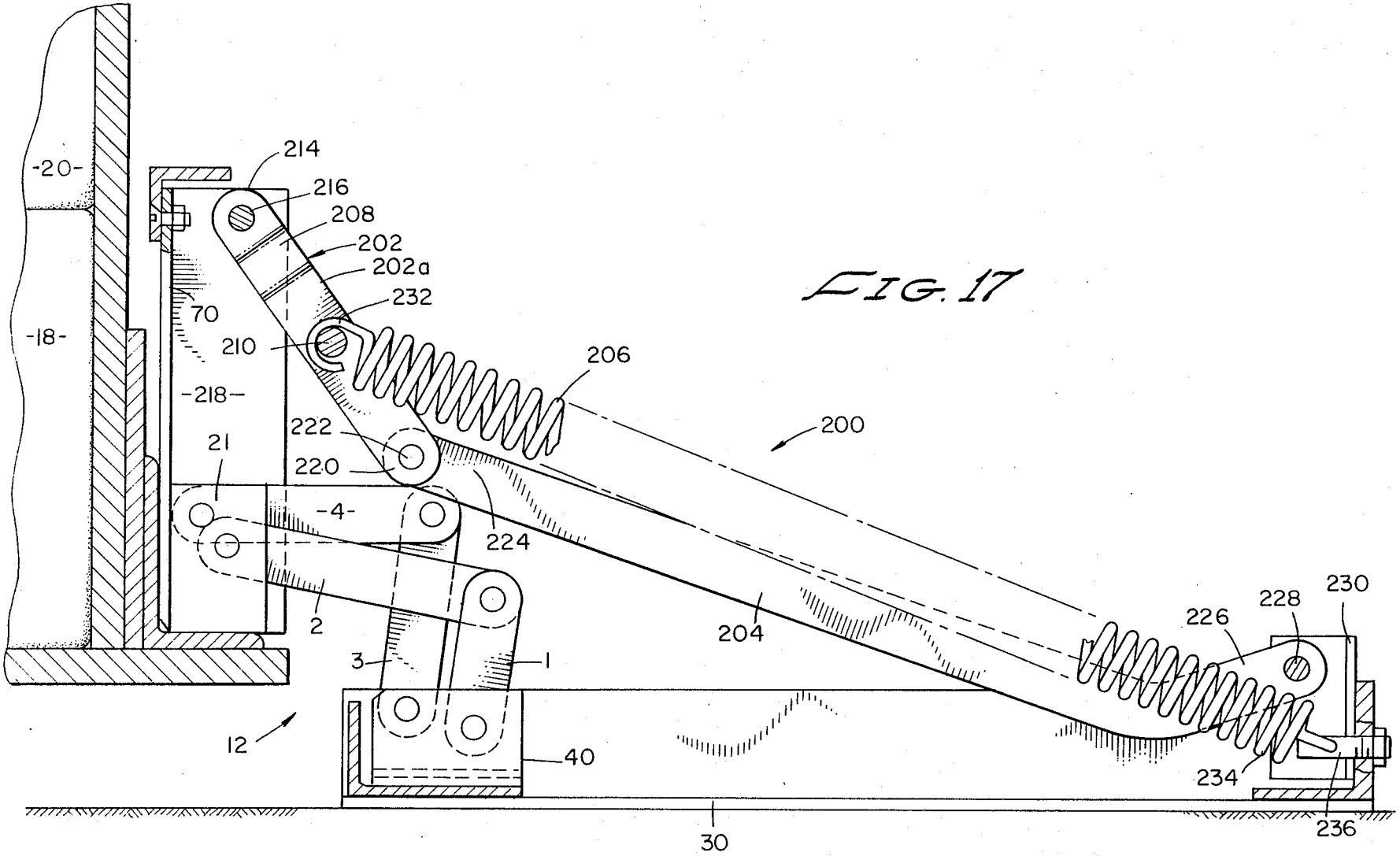
FIG. 17 is a side elevational view, partly cross-section, showing the counter-balancing spring assembly of FIG. 16 in a fully opened condition.

As best shown in FIGS. 14 and 15, the counter-balancing spring assembly 200 is folded inwardly and fits within the confined space provided in the wall cavity 28 when the wall bed 10 is closed. As the wall bed 10 is opened, as shown in FIGS. 16 and 17, and the linkage assembly 12 moves the lower end section 22 of the bed up and outwardly, the link 204 pivots about the pin 228 and the link 202 pivots about the pins 216 and 222, with the extension spring 206 being pulled to extend it. FIG. 17 shows the wall bed 10 in its fully opened position with the extension spring 206 in its fully extended position.

Because two links 202 and 204 are used with the spring 206 being connected to an intermediate portion of the shorter link 202, the spring will provide sufficient counter-balancing force without the spring being extended beyond its maximum length. For example, if the links were eliminated, and the spring was simply connected between, for example, the point at which the pivot pin 216 extends through the bracket 218, the extension spring would be forced to extend beyond its maximum limit and would be permanently damaged, unable to contract to its unstretched position as shown in FIGS. 14 and 15 upon closing the bed 10. By employing the two links 202 and 204 with the extension spring 206 being connected to the shorter link as shown, the extension spring is stretched to near its maximum when the bed is fully opened, as shown in FIG. 17, but not beyond. This is desirable since this spring when unstretched will fit in the confined space available in the cavity 28. The offset portion 208 provides the clearance for the spring 206 to extend along a straight line between the stud 210 and the bolt 236.

If a spring was employed that would not extend beyond its maximum by simply connecting it to the pivot pin 216 and eliminating the link members 202 and 204, such a spring would be too long and would not fit in the confined space available in the wall cavity 28. In other words, it is desirable to use the extension spring 206 which has a length suitable to fit in the confined space available (i.e., approximately the length of the mounting frame 30) and that will stretch to approximately 100% of its maximum extension without exceeding its elastic limit when stretched between stud 210 and bolt 236 with the bed completely open.

Figure 18:
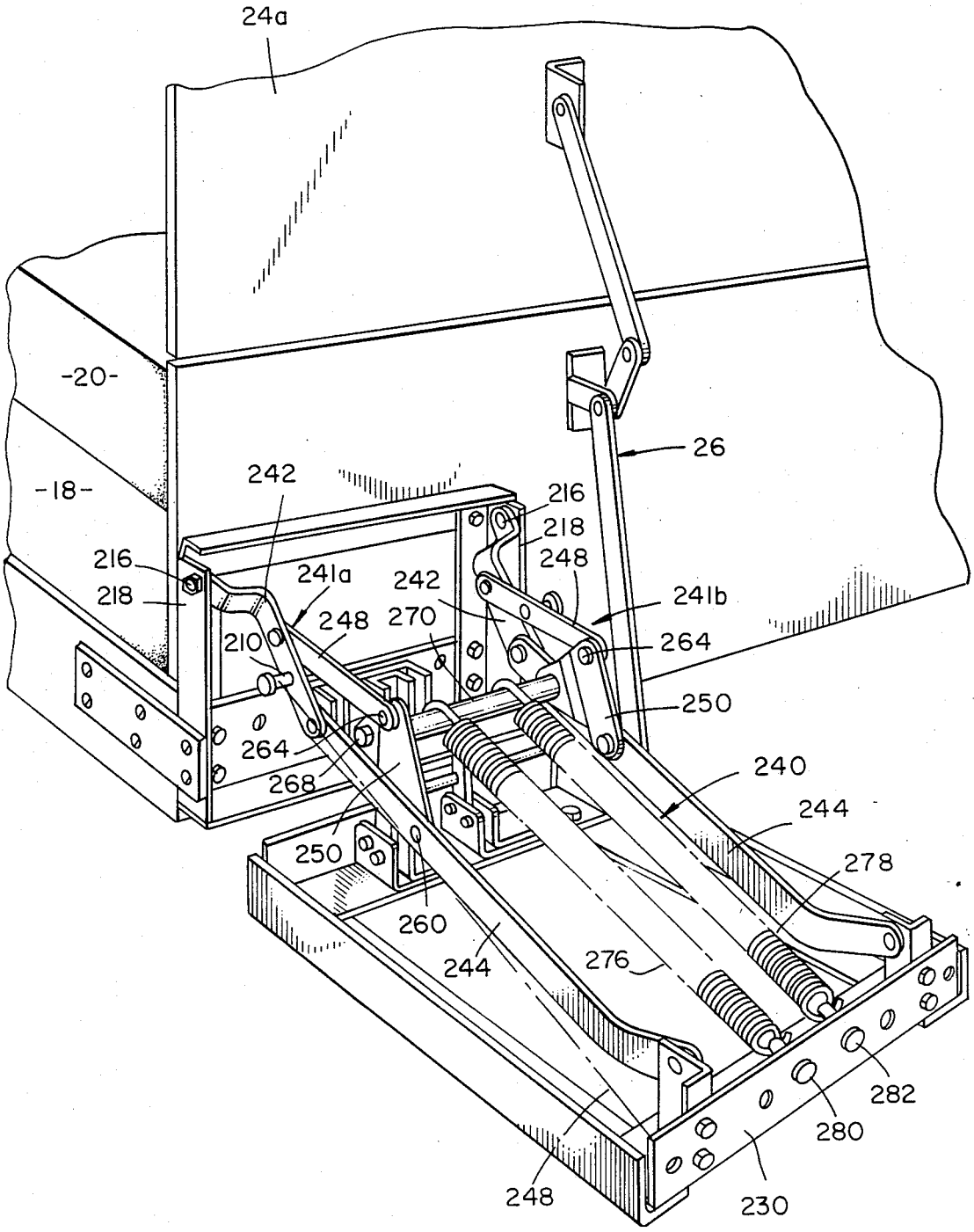
FIG. 18 is a perspective view of the second alternate embodiment of the counter-balancing spring assembly of this invention.
Figure 19:
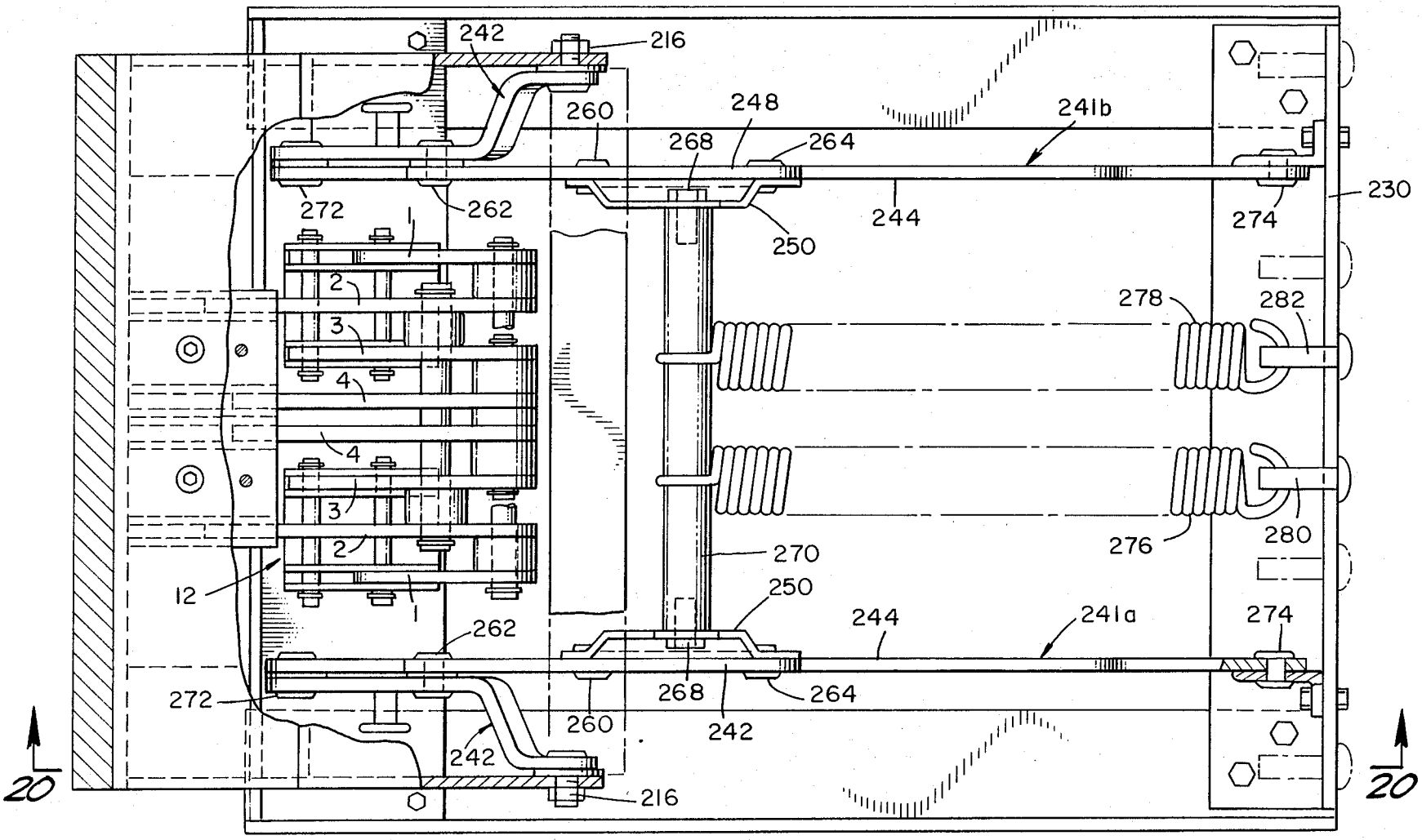
FIG. 19 is a plan view of the second alternate embodiment of the counter-balancing spring assembly of this invention.
Figure 20:
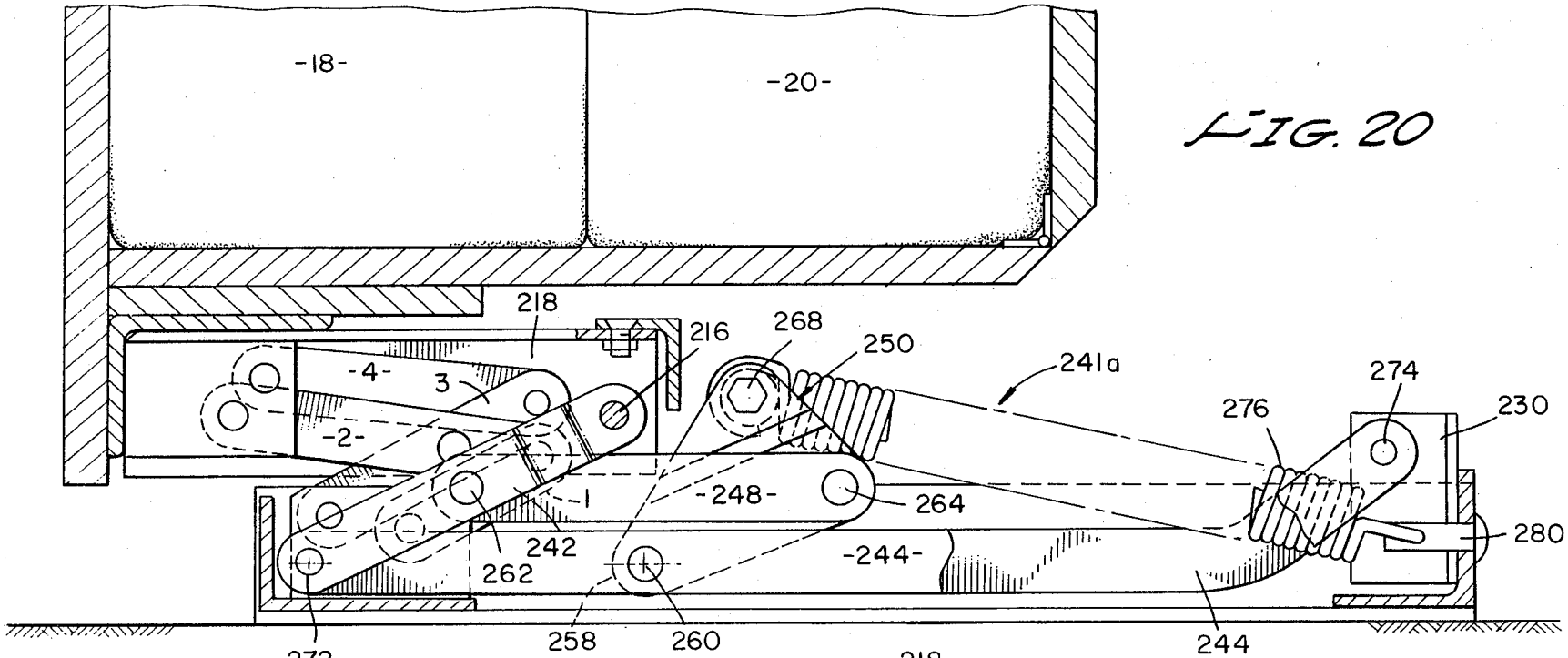
FIG. 20 is a cross-sectional view taken along line 20—20 of FIG. 19.
Figure 21:
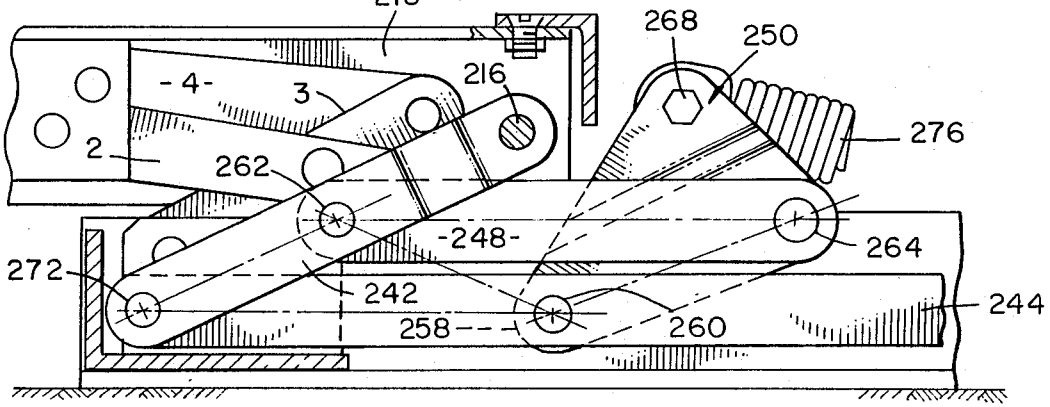
FIG. 21 is an enlarged fragmentary view of the second alternate embodiment of the counter-balancing spring assembly of this invention.
Figures 22, 23:
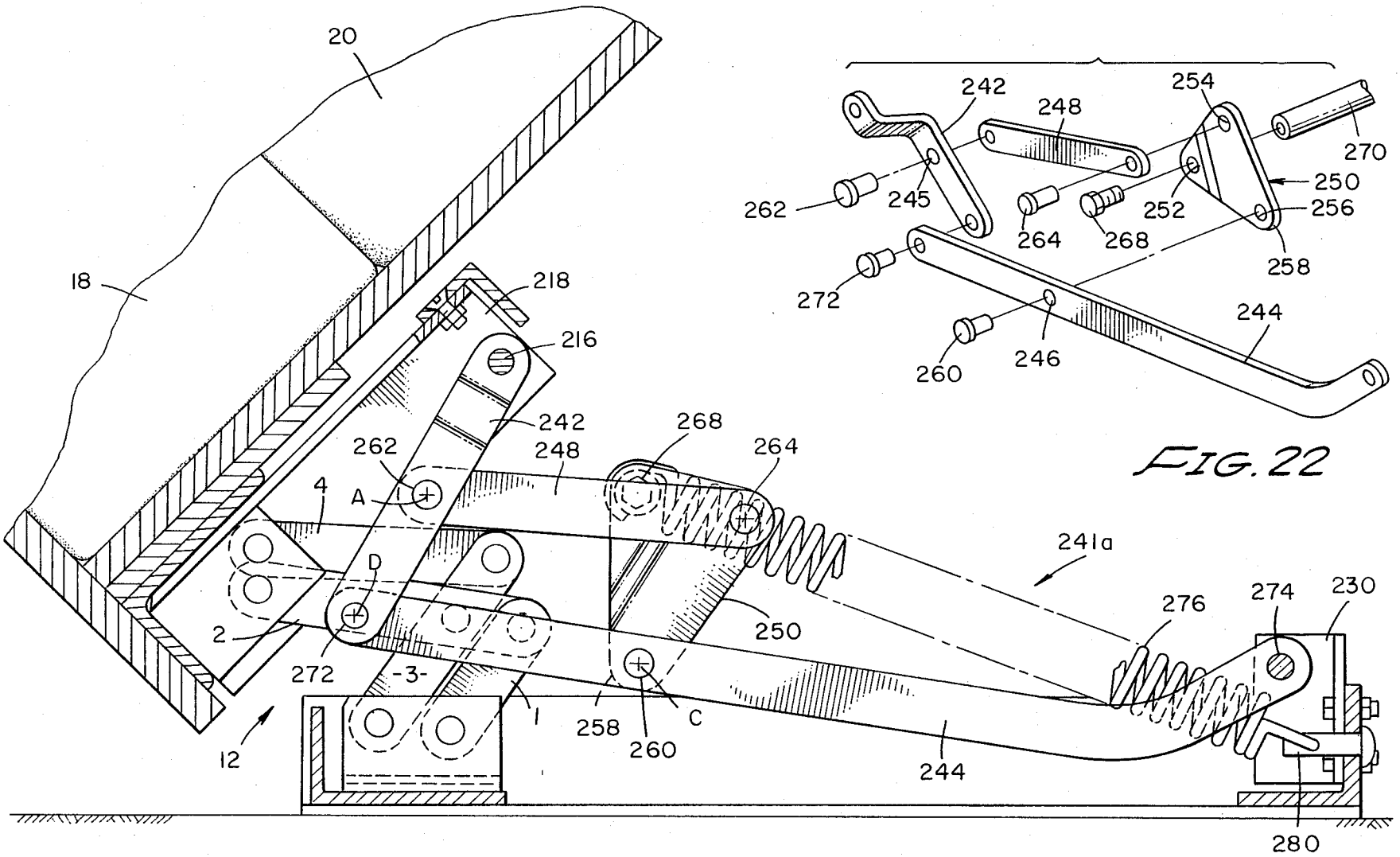
FIG. 22 is an exploded perspective view of the linkage assembly of the second alternate embodiment of the counter-balance spring assembly of this invention.
FIG. 23 is a side elevational view, partly in cross-section, showing the counter-balancing spring assembly of FIG. 20 in a partially open position.

FIGS. 18 through 25 show the second alternate embodiment of the counter-balancing spring assembly of this invention. As best shown in FIGS. 18, 20 and 23, this counter-balancing assembly 240 includes a pair of linkage assemblies 241*a* and 241*b*. Each assembly 241*a* and 241*b* is essentially the same, except 241*a* is a left hand version and 241*b* is a right hand version as shown in FIG. 18. Each assembly 241*a* and 241*b* has two links 242 and 244 similar in construction to the link members used with the counter-balancing spring assembly 200. The differences are that a link 242 shown in FIG. 22 includes a hole 245 and the link 244 shown in FIG. 22 includes a hole 246. In addition to these two links 242 and 244, each linkage assembly 241*a* and 241*b* includes links 248 and 250. The link 248 is simply a straight member which connects link 242 to link 250. Link 250 is in the form of a generally triangular plate with three openings 252, 254, and 256 (FIG. 22) in it near the corners of the triangle. The apex 258 of the triangle points downwardly and a pivot pin 260 passes through the hole 246 in the link 244 to pivotably connect the link 250 to a point intermediate the opposed ends of the link 244. A pivot pin 262 passes through the opening 24 in the link 242 to pivotably connect the link 242 to the link 248. Another pivot pin 264 passes through the opening 266 in the end of link 248 and into the opening 254 in the corner of the link 250. A screw 268 passes through the opening 252 in the other corner of link 250 into a threaded hole (not shown) in a bar 270. A pivot pin 272 connects link 242 to link 244, and a pivot pin 274 connects the link 244 to the bracket assembly 230. As shown in FIG. 18, the bar 270 is connected to the linkage assembly 241*b*.

As shown in FIG. 18, a pair of extension springs 276 and 278 have their hooked ends looped over the bar 270 and their other ends passing through eyelet openings, respectively, in bolts 280 and 282, which extend through the bracket assembly 230. Two additional bolts shown in phantom lines are provided to attach two additional springs between the bar 270 and bracket assembly 230 to handle heavier loads. The bolts preferably are adjustable to allow the initial tension of the springs 276 and 278 to be preset. Although not shown in FIG. 18, an extension spring could be attached between the spring rod 210 and the bracket assembly 230 as depicted by the phantom line 284. Thus, the features of both counter-balancing spring assemblies 200 and 240 could be embodied in a single structure.

Figures 24, 25:
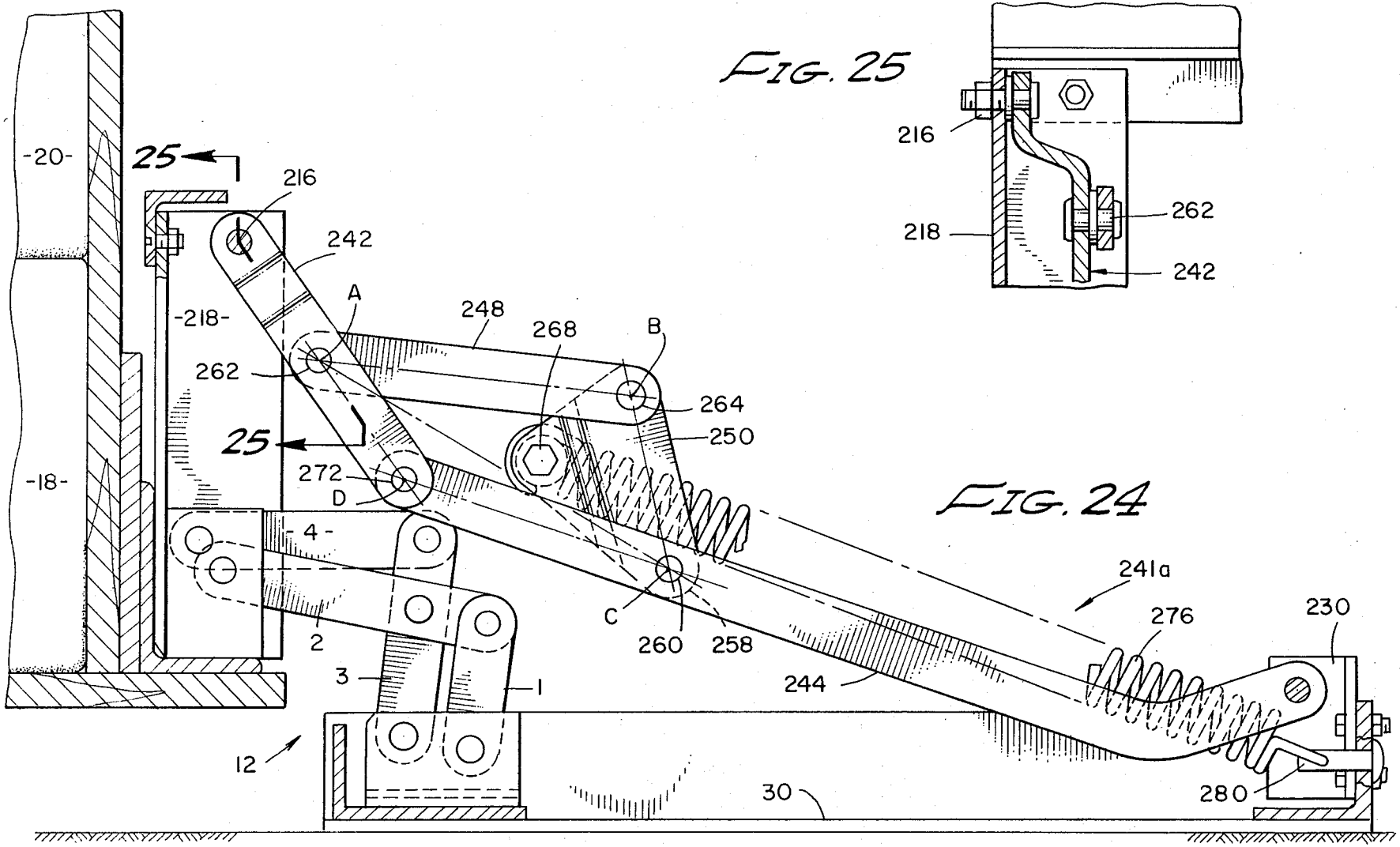
FIG. 24 is a side elevational view, partly in cross-section, showing the counter-balancing spring assembly shown in FIG. 23 in a fully opened position.
FIG. 25 is a cross-sectional view taken along line 25—25 of FIG. 24.

As shown in FIG. 20, when the wall bed 10 is in the closed position, the linkage assemblies 241*a* and 241*b* are collapsed or folded inwardly and the extension springs 276 and 278 are not in extension. As the wall bed 10 is opened as shown in FIG. 23, the linkage assemblies 241*a* and 241*b* begin to unfold. Referring to FIGS. 23 and 24, the points A, B, C, and D may be considered as connected by the lines AB, BC, CD, and DA which inscribe a four sided polygon with the line AC representing a diagonal. The point of connection (screw 268) of the ends of the springs 276 and 278 are outside of this four sided polygon and a substantial distance away from the diagonal AC with the bed 10 in the closed position as shown in FIG. 20. As the bed moves to a fully opened condition, the bar 270 moves inside of the four sided polygon and almost touches the diagonal line AC when the bed 10 in the opened position as shown in FIG. 24.

In contrast to the counter-balancing spring assemblies 14 and 200, this counter-balancing spring assembly 240 with the bed in the fully opened position as shown in FIG. 24 has its counter-balancing forces effectively neutralized. Thus, the bed 10 does not tend to float. This floating condition is undesirable, it being preferred that when the bed 10 is in the open position, it sits firmly on the floor and will require a certain predetermined amount of force to lift it off the floor before the counter-balancing force provided by the assembly will begin to take effect. With the counter-balance spring assembly 240, this occurs when the bed 10 is moved upwardly a sufficient distance so that the linkage assemblies 241*a* and 241*b* begin to fold inwardly moving the bar 270 outside of the four sided polygon structure. At this point the counter-balancing spring force begins to increase rapidly, assisting the user in returning the bed 10 to the closed position shown in FIG. 20.

To fully appreciate the advantages of the counter-balancing spring assembly 240, one needs to consider in general how counter-balancing spring assemblies function. The wall bed 10 being hinged at its lower end, behaves like a teeter-totter. A typical bed will weigh approximately 200 to 300 pounds with the weight acting generally through the center of the bed which is roughly corresponding to the center of gravity. Typically, the length of the bed is about 80 inches and the center will be approximately *40* inches from the hinge point at the lower end. This will generate from 8,000 inch-pounds to 12,000 inch-pounds of moment acting about the hinge 25. The counter-balancing spring assembly 240 is designed to offset this moment, thereby assisting the user in opening and closing the bed. When the bed is being opened, the springs 276 and 278 act to reduce the weight experienced by the user. When the bed 10 is being closed, the springs 276 and 278 assist the user in lifting the bed up to return it to the cavity 28. Force generated by the counter-balancing spring assembly 240 acts on the point corresponding to the pivot pin 216 in the assembly 240. This pivot pin 216 is approximately 8 to 10 inches from the hinge. Consequently, the forces generated by the springs 276 and 278 (and additional springs if necessary) must be on the order of 1,000 to 1,500 pounds or even greater for heavier beds to effectively counter-balance the weight of the bed.

It is desirable to use extension springs which are made from coiled rods where the rods have a diameter ranging from about 0.200 inch to about 0.250 inch, preferably about 0.250 inch in diameter and have a relatively small diameter coil with a diameter ranging from about 1 inch to about 1⅜ inch. Such springs will withstand a deflection of about 50% of their initial length. Any deflection greater than 50% will stretch the spring beyond its elastic limit. For example, a nine inch spring can be deflected up to about pounds per inch of deflection, or a typical spring will develop a maximum of approximately 450 to 900 pounds of force. Thus to generate a force sufficient to counter-balance the weight of a typical bed from about four to eight springs will ordinarily be required. These springs, ranging in length from about 8 to 10 inches, are of a length that can be used in the confined space available in the cavity 28.

Referring to FIGS. 23 and 24, the counter-balancing spring assembly 240 is designed to utilize the above described extension springs, i.e., springs 276 and 278, in a manner that enables these springs to exert a counter-balancing force through the pivot point 216. As the bed 10 is being initially opened, as shown in FIG. 23, most of the force of the springs 276 and 278 will act through the link 248 to transmit the force to the pivot point 216 to offset the weight of the bed. When the bed has been fully opened as shown in FIG. 24, a significant percentage of the force generated by the springs is now acting along the link 244. In other words, there is a transition or shift that occurs that reduces the force acting on the pivot point 216 when the bed 10 is fully opened so that the counter-balancing spring assembly 240 does not tend to lift the bed from the floor. This eliminates the floating problem.

SCOPE OF THE INVENTION

The above description presents the best mode contemplated of carrying out the present invention as depicted by the embodiments disclosed. The combination of features illustrated by these embodiments provides the desirable attributes of this invention. This invention is, however, susceptible to modifications and alternate constructions from the embodiments shown in the drawing and described above. Consequently, it is not the intention to limit it to the particular embodiments disclosed. On the contrary, the intention is to cover all modifications and alternate constructions falling within the scope of the invention and generally expressed by the following claims.

I claim:

1. A wall bed type assembly adapted to be mounted within a cavity and pivoted at one end to move between a closed vertical position and an open horizontal position, said assembly including a bed base for holding a mattress, a mounting element within the cavity, and a counter-balancing spring assembly connected between the bed base and the mounting element, said counter-balancing spring assembly having extension spring means connected to a linkage assembly that enables the spring means to act on thew bed base to provide a counter-balancing force as the bed is being opened and closed, but effectively neutralizes the counter-balancing force when the bed is open, said linkage assembly including four link elements pivotably connected together to form a four sided polygon which changes shape as the wall bed type assembly is opened and closed, said spring means being connected to one of said link elements, with the counter-balancing force of the spring means acting primarily on said one link element during opening and closing and shifting when the wall type bed assembly is fully open to act, at least partially, on another link to effectively neutralize the counter-balancing force.

2. The wall bed type assembly of claim 1 wherein the extension spring means lie lengthwise along the shallow depth dimension of the cavity.

3. The wall bed type assembly of claim 1 including linkage means connecting the mattress support at said one end to the mounting element, said linkage means including a plurality of arm members which move the wall bed from the wall to position said one end beyond the cavity and elevate the bed base to a predetermined height above the floor which generally is equal to the height of a conventional bed.

4. The wall bed type assembly of claim 3 wherein the linkage means includes a pair of pivotably mounted lever arms that are parallel to each other and coupled together to move in unison and maintain said parallel relationship.

5. The wall bed type assembly of claim 1 including a headboard having two sections, means for folding one of the headboard sections so that it lies on the sleeping surface of the mattress upon moving the wall bed to the closed position and for unfolding said one section to position said one section either at a right angle with respect to the sleeping surface of the mattress or tilted rearwardly with respect to said sleeping surface.

6. A wall bed type assembly adapted to be mounted in a cavity and pivoted at one end between a closed vertical position and an open horizontal position, said assembly including a bed base for holding a mattress, a mounting element within the cavity, and a counter-balancing spring assembly connected between the bed base and mounting element, said counter balancing spring assembly including first, second, third and fourth link members, each having first and second opposed ends, said first link member having its first end pivotably connected to the first end of the second link member, with the second end of the second link member being pivotably connected to the mounting element, said third link member having its first end pivotably connected to the first link member at a point intermediate the first and second ends of the first link member and its second end pivotably connected to the first end of the fourth link member, said fourth link member having its end pivotably connected to the second link member at a point intermediate the first and second end of the second link member, and extension spring means having one end connected to the first end of the fourth link member and another end connected to the mounting element near the second end of the second link member.

7. A wall bed type assembly adapted to be mounted within a cavity and pivoted at one end to move between a closed vertical position and an open horizontal position, said assembly including a headboard having two sections, a bed base for holding a mattress, a mounting element within the cavity, and a counter-balancing spring assembly connected between the bed base and the mounting element, said counter-balancing spring assembly having extension spring means connected to a linkage assembly that enables the spring means to act on the bed base to provide a counter-balancing force as the bed is being opened and closed, but effectively neutralizes the counter-balancing force when the bed is open, linkage means connecting the mattress support at said one end to the mounting element, said linkage means including a plurality of arm members which move the wall bed from the wall to position said one end beyond the cavity and elevate the bed base to a predetermined height above the floor which generally is equal to the head of a conventional bed, and means for folding one of the headboard sections so that it lies on the sleeping surface of the mattress upon moving the wall bed to the closed position and for unfolding said one section to position said one section either at a right angle with respect to the sleeping surface of the mattress or tilted rearwardly with respect to said sleeping surface, said means for folding and unfolding the headboard having a rigid arm which is attached and detached to change its effective length to thereby control the angular relationship of said one section to the sleeping surface.

* * * * *